US012486004B2

(12) United States Patent
Ruehle et al.

(10) Patent No.: US 12,486,004 B2
(45) Date of Patent: Dec. 2, 2025

(54) TRANSPORT BOX FOR SETTING DOWN A WATERCRAFT

(71) Applicants: ATLAS ELEKTRONIK GMBH, Bremen (DE); thyssenkrupp AG, Essen (DE)

(72) Inventors: Christian Ruehle, Lilienthal (DE); Malte Sackmann, Bremen (DE)

(73) Assignees: ATLAS ELEKTRONIK GMBH, Bremen (DE); thyssenkrupp AG, Essen (DE)

( * ) Notice: Subject to any disclaimer, the term of this patent is extended or adjusted under 35 U.S.C. 154(b) by 456 days.

(21) Appl. No.: 18/012,415

(22) PCT Filed: Jun. 21, 2021

(86) PCT No.: PCT/EP2021/066810

§ 371 (c)(1),
(2) Date: Dec. 22, 2022

(87) PCT Pub. No.: WO2022/002664

PCT Pub. Date: Jan. 6, 2022

(65) Prior Publication Data

US 2023/0234677 A1 Jul. 27, 2023

(30) Foreign Application Priority Data

Jul. 2, 2020 (DE) ..... 10 2020 208 327.4

(51) Int. Cl.
*B63B 27/16* (2006.01)

(52) U.S. Cl.
CPC ..... *B63B 27/16* (2013.01); *B63B 2027/165* (2013.01)

(58) Field of Classification Search
CPC ... B63B 27/00; B63B 27/16; B63B 2027/165; B63B 27/36; B63C 3/10; B63C 3/12; B63G 8/00
USPC ..... 114/259, 268
See application file for complete search history.

(56) References Cited

U.S. PATENT DOCUMENTS 4,312,287 A 1/1982 Kuo
7,293,521 B1 * 11/2007 Johns, Jr. ..... B63B 27/36 114/259
8,061,932 B1 * 11/2011 Latham ..... B63B 27/36 114/259

(Continued)

FOREIGN PATENT DOCUMENTS

EP 1 249 390 A1 10/2002
EP 2 468 620 A1 6/2012

(Continued)

OTHER PUBLICATIONS

English Translation of International Search Report issued in PCT/EP2021/066810, dated Sep. 30, 2021.

*Primary Examiner* — Daniel V Venne
(74) *Attorney, Agent, or Firm* — thyssenkrupp North America, LLC

(57) ABSTRACT

A transport box may be utilized to set down a watercraft into water with a traction mechanism, with a support for securing the traction mechanism for lowering the transport box, and with a frame that is designed to receive the watercraft in the transport box. The transport box is configured to receive an upper side of the watercraft and to set the watercraft down on a lower side into the water.

11 Claims, 6 Drawing Sheets

(56) References Cited

U.S. PATENT DOCUMENTS

| | | | | |
|---|---|---|---|---|
| 8,430,049 | B1 | 4/2013 | Tureaud et al. | |
| 8,931,427 | B2 * | 1/2015 | Mueller | B63B 23/32 114/259 |
| 9,120,543 | B2 * | 9/2015 | Toce | B63C 3/06 |
| 2009/0151617 | A1 | 6/2009 | Lambertus | |
| 2018/0304977 | A1 | 10/2018 | Grant et al. | |

FOREIGN PATENT DOCUMENTS

| | | | |
|---|---|---|---|
| JP | 851 102900 | A | 9/1976 |
| KR | 102 034 172 | B1 | 10/2019 |
| KR | 102034173 | B1 | 10/2019 |
| WO | 00/71415 | A1 | 11/2000 |
| WO | 2017/064503 | A1 | 4/2017 |

* cited by examiner a)

b)

c)

TRANSPORT BOX FOR SETTING DOWN A WATERCRAFT

CROSS REFERENCE TO RELATED APPLICATIONS

This application is a U.S. National Stage Entry of International Patent Application Serial Number PCT/EP2021/066810, filed Jun. 21, 2021, which claims priority to German Patent Application No. DE 10 2020 208 327.4, filed Jul. 2, 2020, the entire contents of both of which are incorporated herein by reference.

FIELD

The present disclosure generally relates to a transport box for setting down an unmanned underwater watercraft.

BACKGROUND

Unmanned underwater vehicles are typically launched from a vessel and sent on their mission. A typical mission of unmanned underwater vehicles is to destroy sea mines. In order to be able to switch more flexibly and more quickly between different mission sites and hence undertake a larger number of missions in the same period of time, the need has, however, arisen to be able to set down the unmanned underwater vehicles from a helicopter too.

Thus, a need exists for an improved concept for setting down watercraft.

Exemplary embodiments show a transport box for setting down a watercraft into the water by means of a winch. The transport box has a bracket for fastening the traction means for lowering the transport box, and a frame which is designed to receive the watercraft in the transport box, in particular fix it in place. The transport box is designed to receive the watercraft in its upper part and set it down into the water in its lower part.

The invention is described in the context of watercraft, which also include (unmanned) vessels, but is conceived mainly for underwater vehicles, for example autonomous unmanned underwater vehicles (AUVs) or tethered unmanned underwater vehicles (remotely operated vehicles or ROVs), which are no bigger than the size of a person. The invention is in principle also suitable for other underwater vehicles, for example torpedoes, but these are typically larger than the size of a person such that the transport box would then have to be larger than a typical rescue stretcher. However, some exemplary embodiments exclude the use of surface vehicles (for example, vessels). These are primarily the exemplary embodiments in which the frame of the transport box rotates automatically by virtue of its buoyancy when the transport box is immersed in the water. The watercraft is here unavoidably launched under water.

Watercraft refer to both (submersible) underwater vehicles and (floating) surface vehicles, for example vessels. The transport box is moreover advantageously used for unmanned watercraft. Manned watercraft would probably be too large to allow them to be set down from a helicopter.

The transport box has been developed for use with a helicopter. It has, however, been shown that it also facilitates the setting down of the transport box, for example from a vessel. The onboard crane with a special launching device is typically used in order to set down the unmanned watercraft from the vessel. In this method, the launching device is placed over the underwater vehicle from above, which requires carrying by hand or a hoisting device. Moreover, the preparation for a mission takes place unprotected on deck so that the watercraft with the launching device can be picked up by the onboard crane. Personal safety and flexibility for the missions is thus also increased on a vessel by virtue of the claimed toploadable transport box. In addition to use in a helicopter or on a vessel, it is also possible to use the transport box for setting down by means of the traction means from any other types of base station, for example oil platforms or a port facility. The term base station also comprises the helicopter and the vessel.

DETAILED DESCRIPTION

Figure 1:
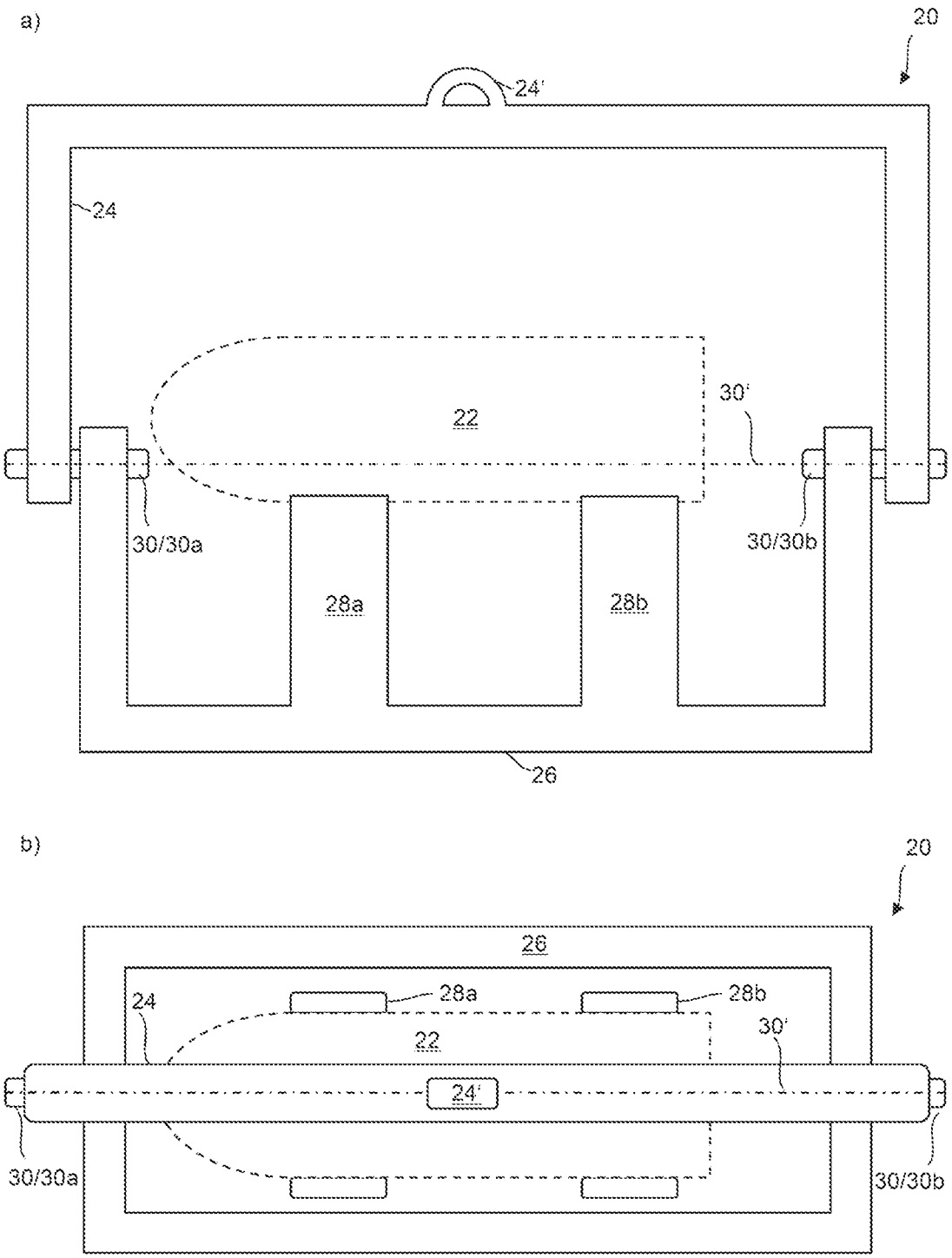
FIG. 1 is a schematic view of an example transport box for setting down a watercraft by way of a traction means, with FIG. 1*a* showing a side view and FIG. 1*b* showing a plan view of the transport box.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The present disclosure generally relates to a transport box for setting down an unmanned watercraft, including an unmanned (for example, tethered) underwater vehicle, by way of a traction means (for example, a winch), for example from a helicopter or other base station.

The water is typically sea water, i.e. salt water, because this is where unmanned watercraft are predominantly used. The transport box can, however, also be used in fresh water.

In particular a rope, preferably in the form of a winch, is used as the traction means. This can be the rescue winch which is installed as standard on many helicopters. The rescue winch is provided for rescuing people who can be pulled into the helicopter from the ground on a rescue stretcher. Instead of the rescue stretcher, the transport box can now be lowered from the helicopter and pulled up again by means of the rescue winch. The transport box advantageously has dimensions that are no greater than the rescue stretcher such that it can be handled by the helicopter crew in the same way as the rescue stretcher. Alternatively, a telescopic rod or the like could, for example, also be considered to lower the transport box into the water from the helicopter. If the transport box cannot be handled with the rescue winch, for example because of its weight, the helicopter can also have a further winch, for example connected to a boom, by means of which the transport box can then be lowered into the water. It has been shown that the transport box can also simplify the lowering of the watercraft from a vessel or another base station. A boom with a winch, for example in the form of an onboard crane, by means of which the watercraft is set down into the water can thus be arranged on the base station.

The bracket is, for example, a U-shaped piece of the transport box. The frame is mechanically connected to the bracket and is typically situated below the bracket when the transport box hangs suspended in the air on the traction means by means of the bracket.

The transport box is conceived primarily for multiple use with a watercraft which is used only once. This is necessarily the case because the underwater vehicle is itself destroyed when destroying the sea mine.

The idea is to provide a simple transport box which can be used for standard helicopters in order to lower the watercraft from the helicopter into the water and set it down there. This is made possible by the bracket which can be fastened on the rescue winch of the helicopter. For safety reasons, it is moreover as far as possible avoided to carry heavy objects such as the watercraft or the transport box or move them by hand in the helicopter without them being fixed in place. However, because it is intended for the transport box to be used for multiple watercraft during an operation, and also to increase personal safety, the transport box in the helicopter is advantageously loaded from above whilst the transport box itself rests safely on the cabin floor of the helicopter. In contrast, it is advantageous to set the watercraft down into the water downwards. This minimizes the risk of collision between the watercraft and the frame when the former accelerates and leaves the confines of the frame. Setting down downwards, however, has the advantage in particular for underwater vehicles that, when the frame is submerged, they can first sink down before then accelerating. This is possible because underwater vehicles are often negatively trimmed and thus, when stationary, invariably sink toward the lake or sea bed. Alternatively, the buoyancy can be controlled accordingly (for example, by means of a lift-generating engine in the underwater vehicle).

In one exemplary embodiment, the frame can move relative to the bracket in order to receive the watercraft in its upper part and deliver it into the water in its lower part. Thus, the frame can, in a similar fashion to a clamshell bucket of an excavator, have a split opening which releases the watercraft when it is to be set down into the water. However, the frame can also perform a rotational movement about an axis which runs through the bracket. The opening of the frame through which the transport box is loaded is then the same opening through which the watercraft is set down into the water. By virtue of the rotation of the frame, the opening is, however, arranged in the upper part of the transport box during loading and in the lower part when the watercraft is set down. Relative terms for the orientation (upper, lower) with reference to the transport box relate to the orientation of the transport box in which it hangs suspended in the air on the traction means. Relative terms for the orientation (upper, lower) with reference to the watercraft relate to the preferred orientation of the watercraft when it moves in the water.

The watercraft but in particular also sensitive components which are necessarily exposed in order to undertake the mission are thus protected by the frame, for example from water hammer, when submerged in the water. The watercraft and/or the components are then released in the water by the movement of the frame such that the mission can be undertaken.

Exemplary embodiments show the transport box which receives the watercraft in a first orientation and sets the watercraft down into the water in a second orientation. This is advantageous, for example, for fixing the watercraft in place. Thus, the watercraft typically has a bracket in its upper part to which the watercraft can be fixed. In order to fill the transport box from above and at the same time ensure that the watercraft is continuously fixed in place, it is therefore advantageous to place the watercraft upside down in the frame. The watercraft should, however, be delivered into the water in its normal orientation. To do this, it can be rotated in the transport box.

In an exemplary embodiment in which the watercraft can be rotated in the transport box, the frame is connected to the bracket by means of a hinge such that the frame can be rotated about an axis of rotation of the hinge in order to receive the watercraft in its upper part and deliver it into the water in its lower part. Because the hinge is connected to the bracket, the axis of rotation runs through the bracket.

The rotation can be effected by an (electric) motor. In this case, the transport box can also set the watercraft down above the surface of the water. This embodiment is also suitable for setting down vessels as the watercraft. In an exemplary embodiment which is suitable only for underwater vehicles, the frame has a buoyancy element which has a lower density than the water such that the frame assumes a first position relative to the bracket in the air and assumes a second position relative to the bracket in the water in order to receive the watercraft in its upper part and deliver it into the water in its lower part. In particular, the buoyancy element is thus designed in such a way that the whole frame and all the elements rigidly connected to the frame have a lower average density, i.e. a lower density in total, than the water. With reference to the preceding exemplary embodiment, when the transport box is lowered, the frame can first hang from the bracket in such a way that the bracket spans the opening of the frame, through which the transport box can be loaded with the watercraft. This can be referred to as the first position.

However, as soon as the frame is submerged in the water, it can move relative to the bracket, in particular rotate about an axis of rotation which runs through the bracket. This is, for example, possible when the bracket and the frame are connected to each other by means of the hinge. If the transport box is completely underwater, the frame can be rotated by, for example, 180°. The opening for loading the transport box now points downward. This can be referred to as the second position. The watercraft can leave the transport box again through this opening.

In one exemplary embodiment, the transport box comprises the absence of an electrical connection by a cable with an operating unit when the transport box is lowered into the water. The operating unit is arranged in the base station. In the base station, the transport box can be connected to the base station by means of a cable, for example in order to charge a battery of the transport box or exchange relatively large amounts of data. As soon as the transport box is lowered, i.e. in any case as soon as the transport box touches the water, there is however no longer any electrical connection by cable between the base station and the transport box. The only connection between the base station and the transport box is the traction means. However, the traction means establishes a purely mechanical connection. The winch arranged on the base station can thus be used only to lower the transport box.

A special winch or a special rope can of course also be used in order to establish an electrical connection between the base station and the transport box in parallel to the rope or in the rope. However, this in turn requires structural adaptation in particular of the helicopter, which should be avoided where possible.

In exemplary embodiments, the watercraft comprises an underwater vehicle. In other words, the transport box of this exemplary embodiment is advantageously suitable for underwater vehicles. The transport box has direction-finding equipment which is designed to determine a current position of the underwater vehicle. The current position is typically determined relative to the direction-finding equipment. The direction-finding equipment can locate the underwater vehicle acoustically, i.e. determine a direction and/or a distance relative to the underwater vehicle. This can be effected by means of active sonar. Alternatively, the underwater vehicle can at a predetermined point in time acoustically emit a signal which is detected by the direction-finding equipment. The duration can be determined as the difference between the predetermined point in time and when the signal arrives at the direction-finding equipment. The direction from which the signal arrives can be determined by means of at least two or at least three (when the azimuth and elevation, also referred to as the depth angle, are to be measured) hydroacoustic transducers which are also referred to as hydrophones.

The exemplary embodiments with the direction-finding equipment are preferably suitable for underwater vehicles. Underwater vehicles could be located more simply, for example by means of radar, directly from the base station.

In this exemplary embodiment, the transport box moreover has a computing unit which is designed to steer the underwater vehicle to a target position based on the current position of the underwater vehicle. However, the target position is typically subject to some uncertainty such that the underwater vehicle can itself perform further precise locating (also referred to as relocating), in particular by means of active sonar or an underwater camera, in the vicinity of the target position in order to find the target independently of the accuracy of the set target position. However, the computing unit can in principle also be arranged in the base station and the transport box controlled from there.

In one exemplary embodiment, the direction-finding equipment is arranged in the transport box in such a way that a sensor head of the direction-finding equipment is arranged between the frame and the bracket during the lowering of the transport box into the water, and the sensor head of the direction-finding equipment is arranged below the frame and the bracket in the water. This can be achieved by the direction-finding equipment being connected to the frame and the frame rotating in the water about an axis through the bracket. The sensor head of the direction-finding equipment has the hydroacoustic transducers. The direction-finding equipment, in particular the sensor head, is thus at least partially protected by the bracket and the frame whilst it is being lowered but in the water it can receive a water hammer from almost all directions without it being deflected or damped by the frame.

In one exemplary embodiment, the transport box has a holder for a dispenser of a signal line of the watercraft, wherein the holder interacts with the dispenser in such a way that the dispenser is arranged between the frame and the bracket whilst the transport box is being lowered into the water, and an outlet of the dispenser projects deeper into the water than all the other elements of the transport box after the watercraft has been set down into the water. The dispenser of the signal line is thus at least partially protected by the bracket and the frame during the lowering but in the water the signal line cannot get caught on an element of the transport box when the watercraft moves in a circle at the level of the outlet. The signal line is thus protected.

The signal line is, for example, a fiber optic cable by means of which the watercraft is connected to the transport box, advantageously during the whole mission. The watercraft is thus a tethered unmanned underwater vehicle. The watercraft can be steered to the target position by means of the signal line, for example based on the current positions determined by the direction-finding equipment. A signal can moreover also be communicated by means of the signal line to the watercraft that the latter should emit the acoustic signal for direction finding by means of the direction-finding equipment. Further information which can be transmitted via the signal line are status data and measured values of the sensors of the underwater vehicle (for example, sonar data) which are communicated, for example, to the operator in the base station. The time at which the signal is communicated is also referred to as the predetermined time. The signal for emitting the acoustic signal can be sent to the watercraft manually by an operator from the base station or automatically (for example, time-controlled).

The dispenser itself can also be part of the transport box. The transport box then comprises the dispenser for the signal line of the watercraft, wherein the dispenser is arranged in the transport box in such a way that the dispenser is protected by the frame and the bracket whilst the transport box is being lowered into the water, and an outlet of the dispenser projects deeper into the water than all the other elements of the transport box after the watercraft has been set down into the water. The signal line can then advantageously be connected to the watercraft by means of a plug.

The signal line can be wound up in the dispenser so that there is always enough signal line present for the watercraft to be able to complete its mission. However, the dispenser can also serve just as protection for that part of the signal line which is connected to the transport box so that this part of the signal line does not get caught in the transport box. A supply of more signal line is optionally present in the watercraft.

In exemplary embodiments, the frame has a quick-release locking means which is designed to receive and automatically fix in place a retaining device connected to the watercraft, wherein the quick-release locking means is designed to unfix the watercraft when the quick-release locking means receives a corresponding signal. For example, the computing unit of the transport box can be actuated from the base station in such a way that the computing unit sends the signal for releasing the retaining device to the quick-release locking means. The quick-release locking means is characterized by the uncomplicated fixing of the retaining device in place with just a single hand movement. In particular, turning a screw in a thread by more than one turn can no longer be performed with a single hand movement and hence can no longer be considered as a quick-release locking means. The quick-release locking means comprises, for example, multiple claws similar to a chuck with which the retaining device interlocks when the retaining device is inserted into the claws. The retaining device can be a (metal) pin, spherical head, or also a lug which fits the quick-release locking means or its retaining claws. The watercraft can have an appropriate receptacle, for example a thread, for the retaining device in order to be able to connect the retaining device to the watercraft.

Exemplary embodiments show the transport box comprising a float which has an antenna which is designed to receive a signal from an operating unit and relay it to a computing unit of the transport box or to send a signal from the computing unit to the operating unit, wherein the float is designed to be arranged movably on the traction means. The transport box is moreover shown in a system comprising the base station for setting the watercraft down into the water. The float is arranged in the system above the bracket, movably on the traction means.

The float can advantageously move freely along a traction means such that it is situated at all times on the surface of the water independently of the depth to which the transport box is submerged. A signal line can be arranged between the antenna and the computing unit in order to relay the signal from the base station to the computing unit. The transport box can thus also be controlled underwater from the base station by means of a wireless connection, for example a radio connection, for example a WLAN (wireless local area network). Data relating to the watercraft can moreover be sent to the base station via the wireless connection. One possible signal which can be sent to the transport box from the base station is to set the watercraft down into the water, i.e. in exemplary embodiments to open the fixing element or the quick-release locking means.

Exemplary embodiments moreover show a system comprising the transport box for setting down a watercraft into the water by means of a traction means, and a loading device for loading the transport box with the watercraft. The loading device is designed to receive the watercraft in such a way that a retaining device by means of which the watercraft can be fixed in place in the frame of the transport box is arranged so that it is exposed. The loading device has a tipping mechanism which is designed to tip the watercraft into the transport box in such a way that the retaining device of the watercraft enters a fixing area of a fixing element and is fixed in place in the frame by the fixing element (manually initiated or automatically). The quick-release locking means can be used as the fixing element. The fixing area is the area in which the fixing element can fix the retaining device in place. When an interlocking fixing element is used, the retaining device enters the fixing area at the time of the interlocking. The loading device, optionally also further loading devices, is advantageously arranged in or on the base station such that the loading device can load the transport box with the watercraft. The loading device can furthermore ensure elastic mounting of the stowed watercraft such that any stresses from shocks or vibrations are sufficiently damped by the base station.

Analogously, a method for setting down a watercraft into the water by means of a transport box with the following steps is shown: introducing the watercraft into the upper part of the transport box, receiving the watercraft in the transport box; fastening a traction means on the transport box; lowering the transport box into the water; setting down the watercraft into the water from the lower part of the transport box. The sequence of the steps can vary within the scope of what is technically implementable. Receiving the watercraft can comprise fixing the watercraft in place in the transport box.

Before exemplary embodiments of the present invention are explained in more detail below with the aid of the drawings, it should be pointed out that elements, watercraft, and/or structures which are identical, are functionally similar, or have the same effect are provided with the same reference numerals in the different Figures such that the description of these elements which is explained in the different exemplary embodiments can be exchanged with one another or can be applied to one another.

FIG. 1*a* shows a schematic side view of a transport box 20 for setting down a watercraft 22 into the water by means of a traction means. FIG. 1*b* shows the transport box 20 in a plan view. The watercraft 22 is not part of the transport box and therefore illustrated in dashed lines. The transport box 20 comprises a bracket 24 and a frame 26. The bracket 24 serves to fasten the traction means for lowering the transport box 20. The bracket 24 for fastening the traction means comprises, for example, a lug 24' into which a hook of the traction means can engage.

The frame 26 is designed to receive the watercraft 22 in the transport box 20. For this purpose, the frame 26 has a first support element 28*a* and a second support element 28*b* on which the watercraft 22 is fixed in place. In principle, one support element on which the watercraft is fixed in place is also sufficient but the weight distribution and balancing of the watercraft on two separate support elements 28*a*, 28*b* is simpler, in particular when the support element is not a shell (with a large area). The frame should moreover be designed in such a way that it stands securely on the cabin floor even in the event of rolling or pitching of the helicopter or in a swell when on a vessel or in the event of other movements of the base station.

The bracket 24 and the frame 26 are (mechanically) connected to each other by means of a connecting element 30. The connecting element 30 has, for example, a two-part design and comprises a first and a second subelement 30*a*, 30*b*, configured here as a hinge. Both hinges 30*a*, 30*b* have the same axis of rotation 30' and accordingly form a hinge in functional terms. The hinges 30*a*, 30*b* can be designed as a bolt which in each case passes through the frame 26 and the bracket 24.

The use of the hinges as connecting elements is an option which receives the watercraft 22 in the upper part of the transport box 20 and sets it down into the water in the lower part. The principle of setting down the watercraft 22 is described with reference to FIG. 3.

Figure 2:
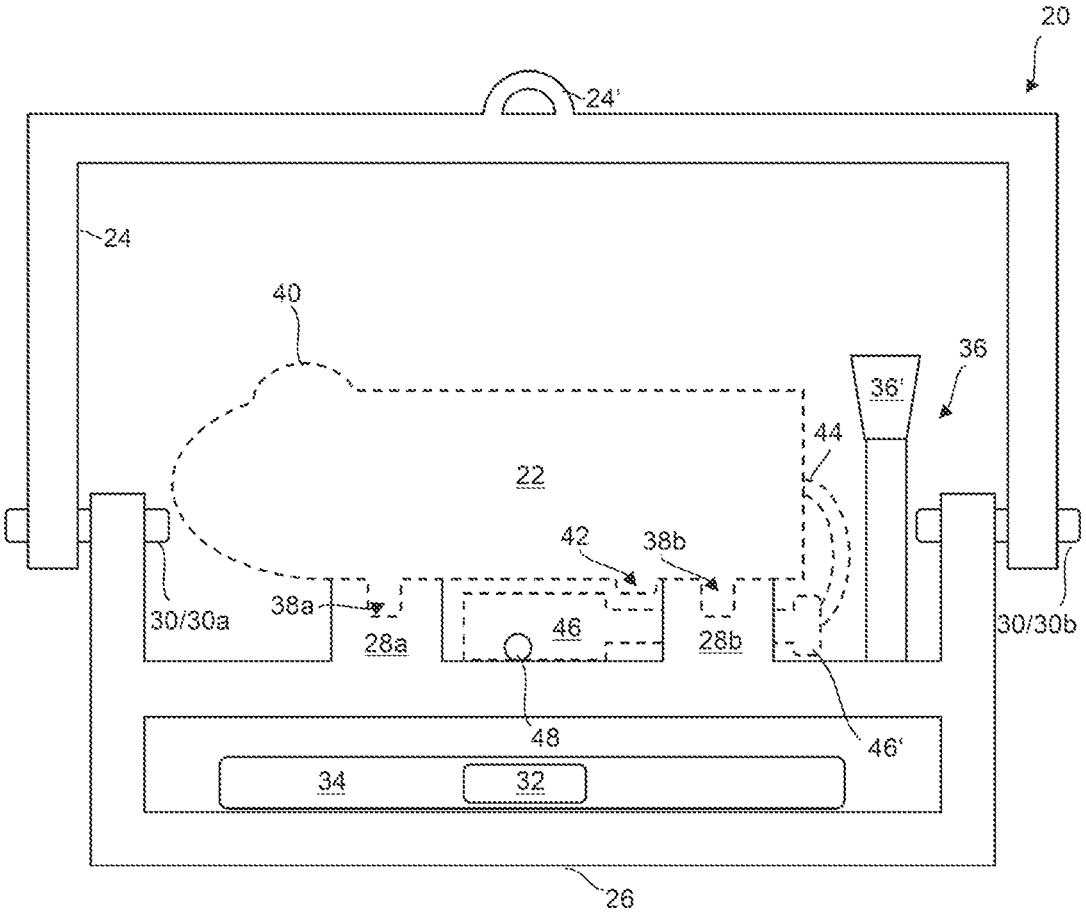
FIG. 2 is a schematic sectional view of exemplary embodiments of a transport box.

FIG. 2 shows a schematic drawing in section of the transport box 20 in exemplary embodiments. Supplementing the features from FIG. 1, the transport box 20 has a computing unit 32. The computing unit 32 is explained in detail with reference to FIG. 6.

In a further exemplary embodiment, the transport box 20 can have a buoyancy element 34. The computing unit 32 can be embedded in the buoyancy element 34. This has the practical advantage that the computing unit 32 does not come into contact with the water. Irrespective of whether the computing unit 32 is arranged in the buoyancy element 34 or separately therefrom, the buoyancy element 34 is an arrangement such that the frame 26 can move (automatically) relative to the bracket 24. A motor can also be used but the buoyancy element has the advantage that rotation takes place automatically when the transport box enters the water and there is no need to expend any further energy. For this purpose, the buoyancy element 34 has a density which is less than the density of the water. The buoyancy element is moreover selected in such a way that the average density of the elements connected to the frame, including the buoyancy element, is less than the density of water.

According to a further exemplary embodiment, the transport box 20 has direction-finding equipment 36. The direction-finding equipment 36 comprises a sensor head 36'. A plurality of hydroacoustic transducers are arranged in the sensor head in order to be able to locate the watercraft 22. The direction-finding equipment 36 is moreover arranged in the transport box 20 in such a way that the sensor head 36' of the direction-finding equipment is arranged between the frame 26 and the bracket 24 whilst the transport box is being lowered into the water, and the sensor head 36' of the direction-finding equipment is arranged below the frame 26 and the bracket 24 in the water. This is implemented in such a way that the sensor head 36' projects beyond the hinge 30 and thus, after the frame has rotated, is arranged, in the water, below the hinge 30 and thus also below the frame. The frame 26 thus has as little influence on the locating of the watercraft 22 as possible. The direction-finding equipment 36 can of course also be fastened upside down directly on the bracket 24 instead of on the frame 26. The sensor head 36' of the direction-finding equipment can, however, have a design such that it then does not extend as deeply into the water. The frame would moreover have to be designed in such a way that it does not damage the direction-finding equipment when the frame rotates relative to the bracket.

In a further exemplary embodiment, the frame 26, in particular the support elements 28*a*, 28*b*, has a quick-release locking means. The quick-release locking means is not shown explicitly but engages into the corresponding retaining devices 38*a*, 38*b* of the watercraft 22 in order to fix the latter in place. The watercraft can be handled safely on the base station and the transport box loaded with a new watercraft more quickly by means of the quick-release locking means. The quick-release locking means can moreover be activated by remote control in order to release the watercraft 20. If a fixing element is provided in each of the support elements 28*a*, 28*b*, the fixing elements can be different from each other, for example have different quick-release locking means.

The watercraft 22 is furthermore shown with two further optional modifications compared with FIG. 1. The watercraft 22 thus has, for example, an (active) sonar 40 in the front region of its lower part. The watercraft can independently locate the target by means of the sonar 40 when it is situated in the vicinity of the target, for example when it has reached the target position. The watercraft 22 furthermore optionally has signal-generating equipment 42 which can emit an acoustic signal (also called a ping) which can be detected by the direction-finding equipment 36 in order to locate the watercraft 22.

The watercraft 22 is moreover optionally connected, by means of a signal line 44, in particular a fiber optic cable, to a dispenser 46 in which a supply of the signal line 44 can be present, for example is rolled up. If the watercraft 22 moves away from the transport box 20, the dispenser 46 lets out more signal line 44 such that the watercraft 22 is ideally connected to the transport box 20 by means of the signal line 44 until the mission is complete. The supply of signal line can optionally also be arranged in the watercraft 22, advantageously in the stern region, or a proportional supply of signal line is situated respectively in both the watercraft and the dispenser 46. The signal line 44 is typically connected to the watercraft 20 such that the dispenser 46 is connected to the transport box only when the transport box 20 is loaded with the watercraft 22, and the signal line 44 and the dispenser 46 are therefore, like the watercraft 22, drawn in dashed lines. For this purpose, the transport box 20 has a holder 48 for the dispenser 46. The dispenser 46 is advantageously arranged on the holder 48 so that it can rotate. The dispenser thus initially takes up very little space and can be arranged below the watercraft 22. As soon as the watercraft is in the water and moves away from the transport box 20, the dispenser 46 can, however, fold out. If the dispenser 46 has a long enough configuration and has been positioned correctly, an outlet 46' of the dispenser can project deeper into the water than all the other elements of the transport box. This is illustrated in FIG. 3*d*.

Figure 3:
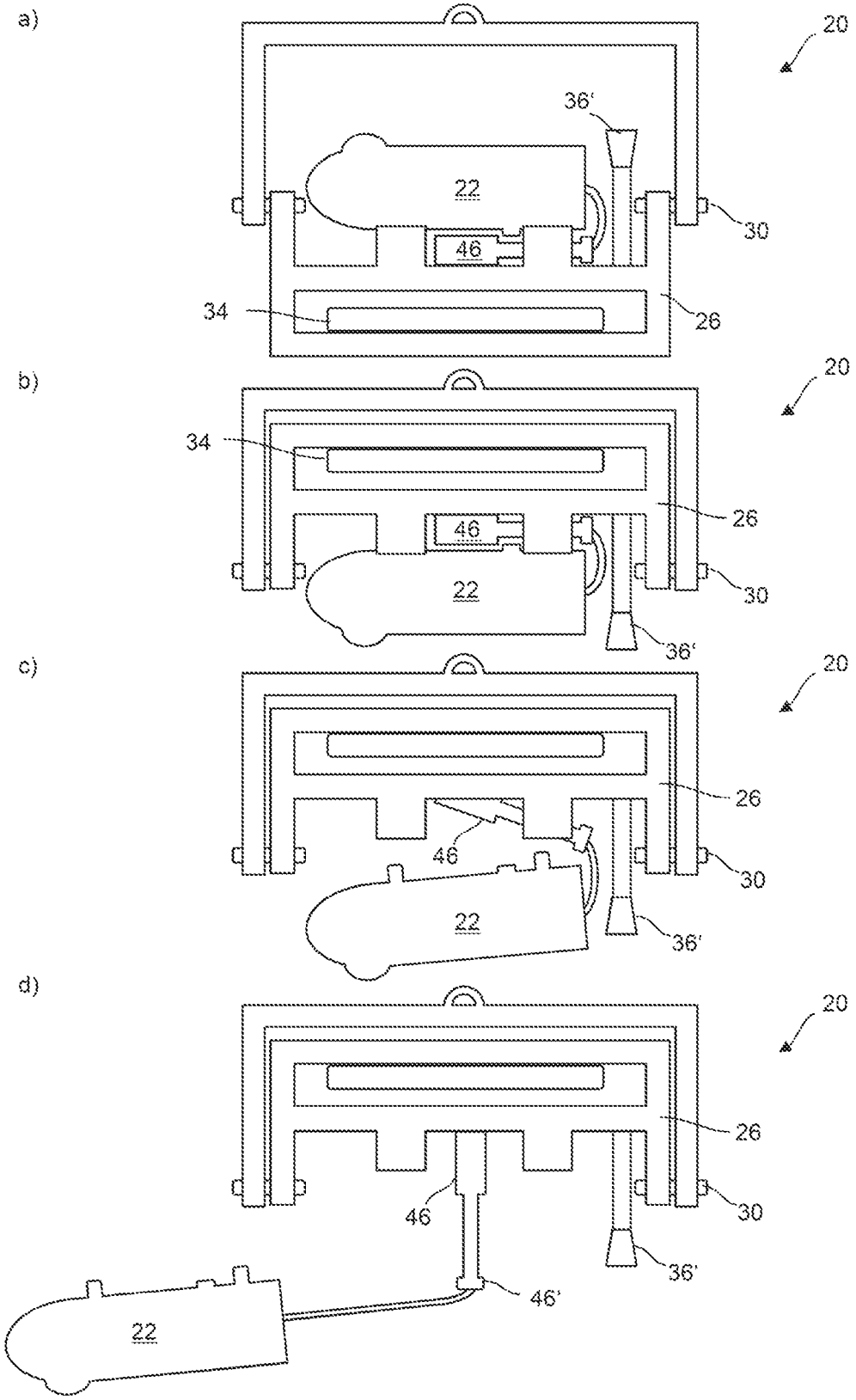
FIG. 3 is a schematic side view of an example transport box, with FIGS. 3*a*, 3*b*, 3*c*, and 3*d* showing a series of different states of the transport device when the watercraft is set down.

FIG. 3 shows, in FIG. 3*a*, FIG. 3*b*, FIG. 3*c*, and FIG. 3*d*, four different states of the transport box 20 and the (underwater) watercraft 22. In FIG. 3*a*, the transport box 20 is hanging in the air on the traction means of the base station. The traction means advantageously remains connected to the transport box 20 throughout such that the transport box can be lifted back into or onto the base station once the mission is complete in order to be fitted there with a new watercraft. The watercraft 22 is primarily designed to undertake just one mission such that there is no need for the watercraft 22 to be redocked on the transport box. The watercraft 22 is thus, for example, also itself destroyed when destroying a sea mine.

FIG. 3*b* shows the transport box 20 submerged in the water. The frame 26 is rotated by approximately 180° about the axis of rotation of the hinges 30, for example by virtue of the action of the buoyancy element 34. The orientation of the watercraft 22 has also been reversed by the rotation of the frame 26. If the watercraft 22 was still upside down in the air, it is now arranged the right way round in the water. Also, the sensor head 36' is, because of the rotation of the frame 26, now deeper in the water than the frame itself.

FIG. 3*c* shows the setting down of the watercraft 22 in the water. The fixing element, in particular the quick-release locking means, has been released (by remote control) and the watercraft 22 sinks down either because of the negative trim or by being actively driven. The dispenser 46 begins to rotate. The rotation can be initiated by an initial pull on the signal line by the watercraft. The initial pull can release a slight tensioning of the dispenser by the frame, as a result of which the rotation is enabled.

FIG. 3*d* shows the beginning of the mission of the watercraft 22. The watercraft 22 is driven and steered to its target position. The outlet 46' of the dispenser 46 now projects deeper into the water than all the other elements of the transport box 20.

Figure 4:
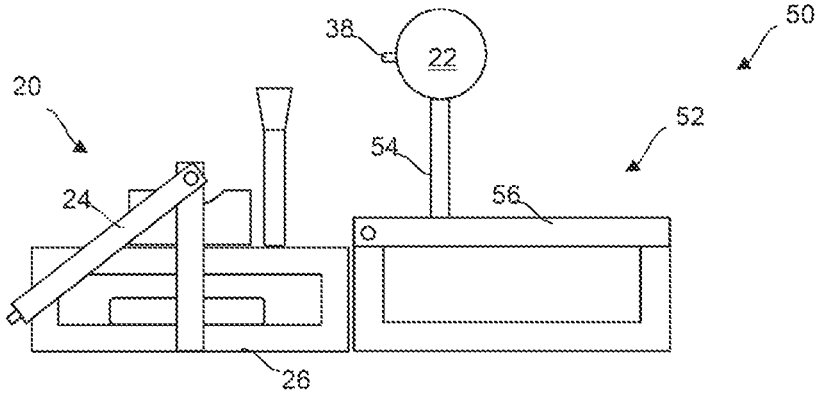
FIG. 4 is a schematic side view of a system with a transport box and a loading device for loading the transport box with a watercraft, with FIGS. 4*a*, 4*b*, and 4*c* showing different states when the transport box is loaded with the watercraft.
Figure 4:
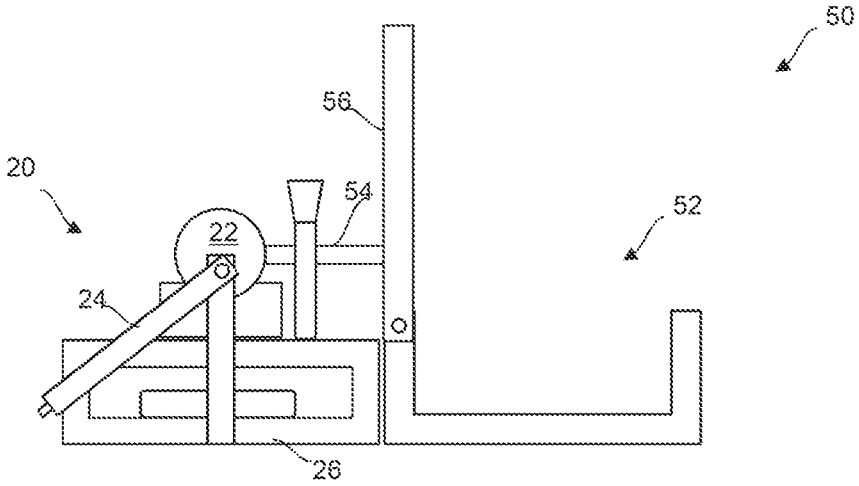
Figure 4:
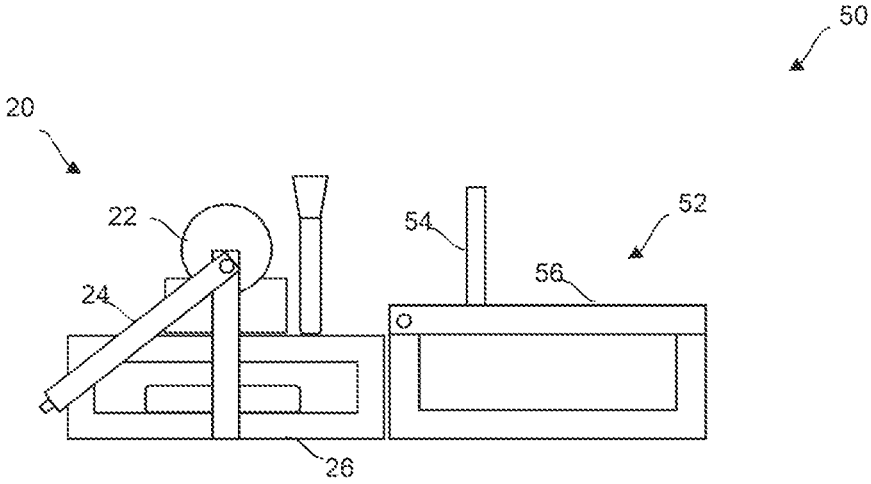

FIG. 4 shows a system 50 with the transport box 20 and a loading device 52 for loading the transport box 20 with a watercraft 22. FIG. 4*a*, FIG. 4*b*, and FIG. 4*c* show in three steps the loading of the transport box 20 with the watercraft 22.

The transport box 20 and the loading device 52 are arranged in a predetermined position relative to each other in FIG. 4*a*. The bracket 24 of the transport box is folded down in order to free up the opening of the transport box, i.e. the frame. The watercraft 22 is held, in particular fixed in place, in the loading device 52 in such a way that the retaining device by means of which the watercraft can be fixed in place in the frame of the transport box is arranged so that it is exposed, i.e. the watercraft is fixed in place in the loading device 52 with different means than in the transport box 20. The loading device 52 now has a tipping mechanism 56 which can tip the watercraft into the transport box in such a way that the retaining device 38 of the watercraft enters a fixing area of a fixing element and is automatically fixed in place in the frame by the fixing element. The tipping mechanism is advantageously designed such that the tipping process can be interrupted at any time and the watercraft is held securely by the tipping mechanism in every intermediate position. This can be effected, for example, by means of a hydraulic cylinder or a spindle (not shown).

The final position of the tipping process is illustrated in FIG. 4*b*. The tipping mechanism 56 is tipped, by way of example, by 90° and, by virtue of the predetermined position, the retaining device 38 of the watercraft 20 and the corresponding fixing element, in particular the quick-release locking means, of the transport box engage precisely in each other. The watercraft is at this moment fixed in place both in the transport box and on the loading device 52. The means 54 for fixing the watercraft in place on the loading device 52 can now be released and the tipping mechanism 56 pivots back into its starting position. This state is shown in FIG. 4*c*. The bracket 24 can be connected to the traction means and lowered into the water.

The loading device 52 optionally also contains the dispenser and the associated signal line in addition to the watercraft 22. At a suitable point in time, during or after the tipping process of the loading device, the dispenser is detached (for example, manually) and fastened on the transport box by means of the holder without any need to disconnect the pre-assembled signal line.

It should be pointed out that the loading device 52 is selected only as an example. In order to store the watercraft in a space-saving fashion, a rack system can in particular also be installed in the base station. Here too, the watercraft can be fixed in place on a corresponding tipping mechanism. The tipping mechanism is here configured individually for different in order to be able to overcome different heights and/or distances from which the watercraft is tipped into the transport box. Tipping levers of different lengths and bent angles of rotation can thus be used in order to make optimum use of the space in the helicopter or another base station. In particular, the tipping mechanism can also rotate the watercraft at an angle other than the 90° which is shown in order to bring the watercraft into the fixing area of the transport box.

Figure 5:
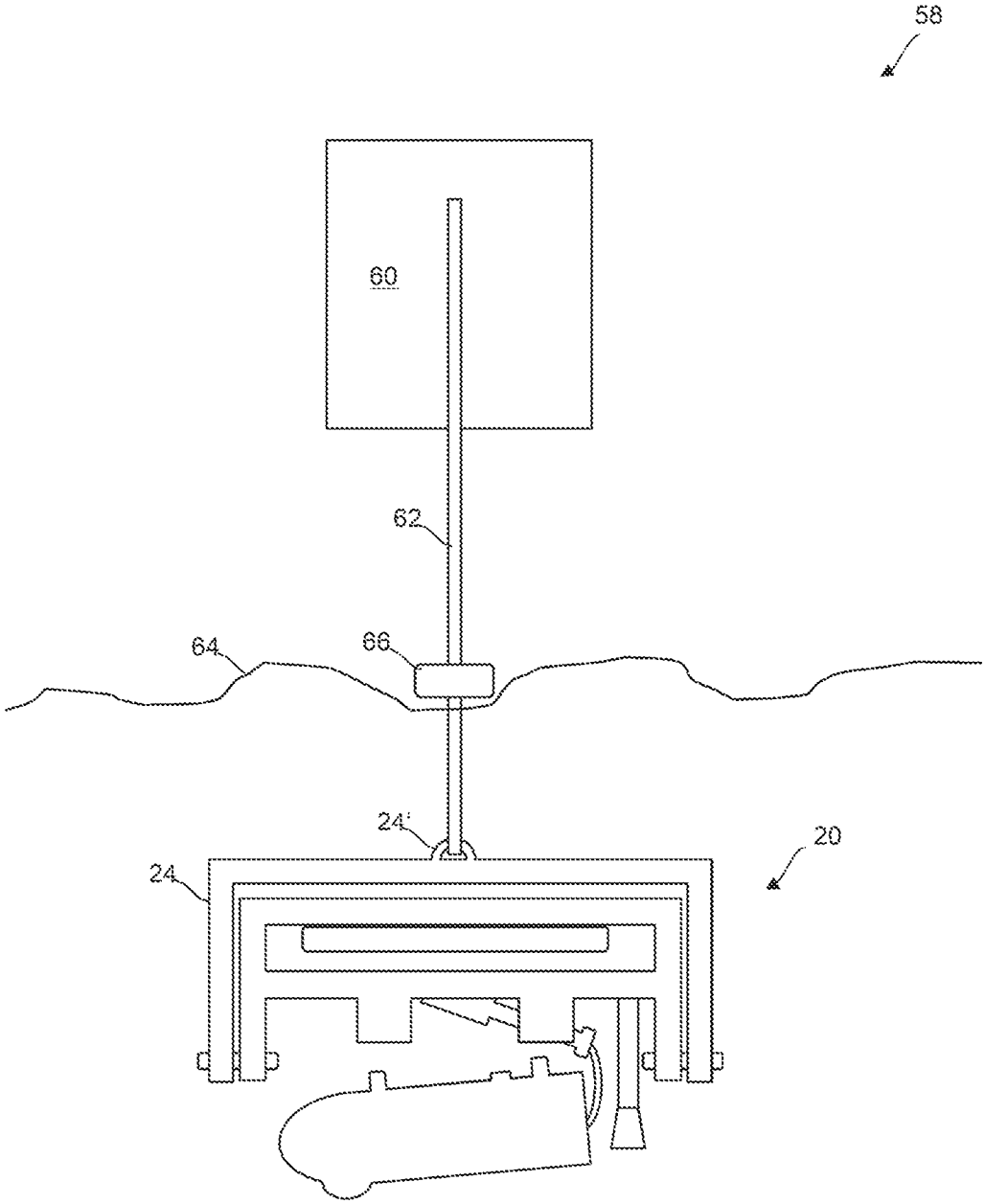
FIG. 5 is a schematic side view of a system with a transport box and a base station for setting down the transport box in water.

FIG. 5 shows a further system 58 comprising the transport box 20, illustrated here in the state according to FIG. 3*c*, and a base station 60. The transport box 20 is (mechanically) connected to the base station 60 by means of a traction means 62, in this case a rope, and is already situated below the surface of the water 64. The transport box has a float 66 which is arranged movably on the traction means. The float is thus situated at all times on the surface of the water as soon as the transport box 20 is situated in the water. The float 66 has an antenna (not shown) which is designed to receive a signal from an operating unit from the base station and relay it to a computing unit of the transport box or to send a signal in the opposite direction from the computing unit to the base station. When outside the water, the float 66 rests on the bracket 24. The lug 24' is advantageously shaped such that a stable storage position for the float 66 results. The float is typically connected to the computing unit of the transport box by a cable (not illustrated).

Figure 6:
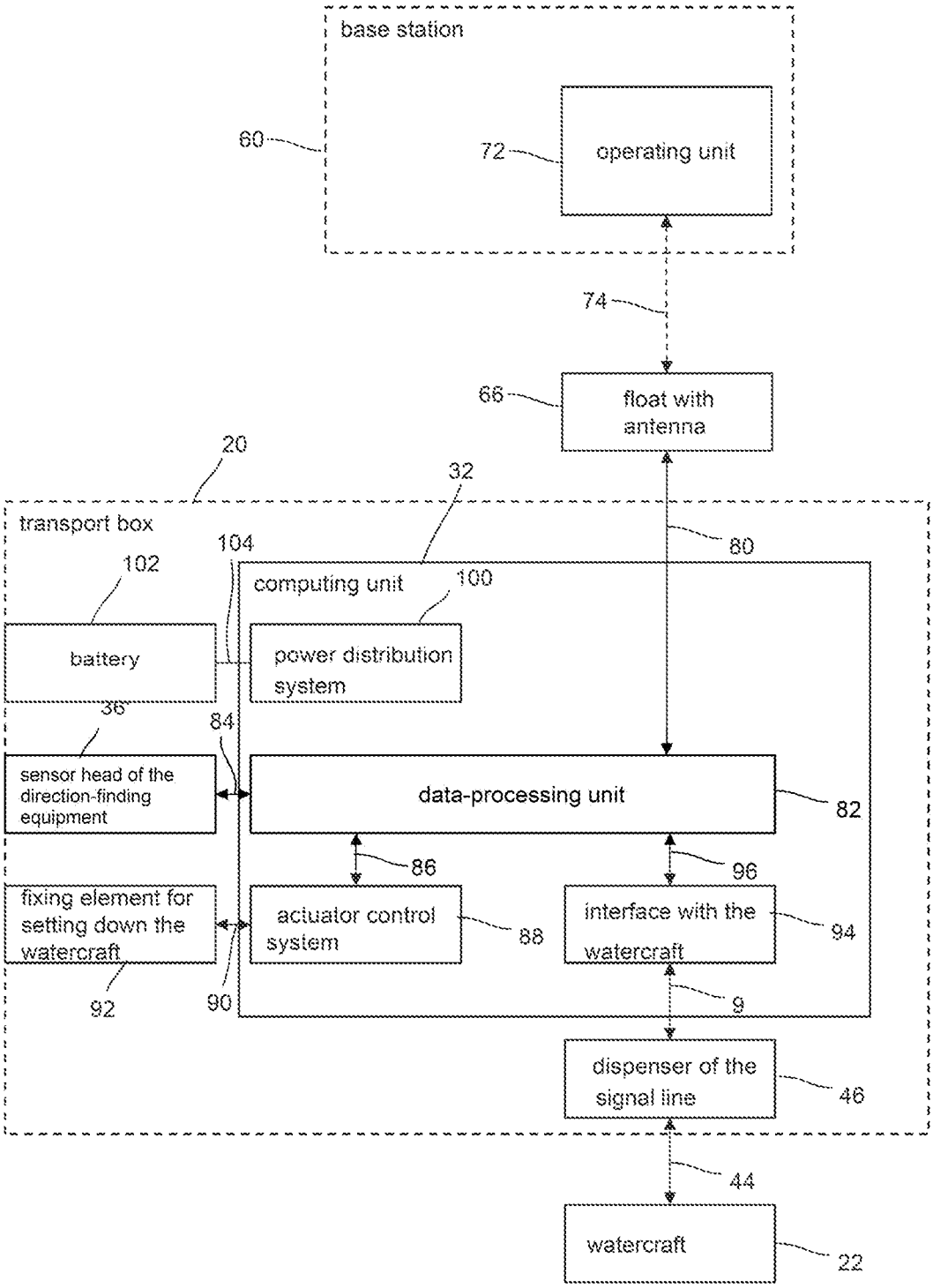
FIG. 6 is a schematic block diagram of a computing unit of a transport box for illustrating flow of signals in exemplary embodiments.

FIG. 6 shows a schematic block diagram of possible signal flows for controlling the transport box in exemplary embodiments. An operating unit 72 is arranged in the base station 60. The transport box can be controlled by means of the operating unit 72. Signals from the operating unit to the transport box (and vice versa) can be communicated to a data-processing unit 82 of the computing unit 32 of the transport box 20 via a signal connection 74. Signals comprise both (usage) data and control signals. This is in principle possible by means of a cabled signal connection. However, a wireless signal connection 74, for example by means of a WLAN or any other suitable radio standard, is shown. However, the signal does not penetrate deep enough into the water to be able to send the signals directly to the data-processing unit 82 or an antenna arranged on the transport box. Therefore, a float 66 with an antenna for receiving the signal from the operating unit (or sending it to the operating unit) is arranged between the base station 60 and the transport box 20, advantageously so that it can move about the traction means. There is a first signal connection 80 between the antenna 66 and the data-processing unit 82. The first signal connection 80 is typically a cabled one and accordingly extends from the float 66 to the transport box. The data-processing unit 82 processes the incoming data from the transport box 20.

Thus, the sensor head 36' of the direction-finding equipment can also have a (second) signal connection 84 to the data-processing unit 82. The sensor head 36' sends, for example, the position of the watercraft 22 to the data-processing unit 82. Conversely, the data-processing unit can also communicate the trigger, i.e. the predetermined time at which the watercraft 82 emits its acoustic signal (ping), to the sensor head so that the latter responds to the acoustic signal. In other words, the sensor head 36' can thus be switched into active mode or listening mode. Otherwise, the sensor head can be switched into passive mode such that the consumption of energy is minimized.

The data-processing unit 82 can moreover have a (third) signal connection to an actuator control system 88. The actuator control system 88 can actuate, i.e. preferably open, the fixing element 92, in particular the quick-release locking means, by means of a (fourth) signal connection 90 in order to set the watercraft 22 down into the water. The signal for opening the fixing element can be sent by the operating unit 72. For checking purposes, the fixing element 92 can report the successful opening via the fourth signal connection 90.

The computing unit 32 can furthermore have an interface 94 with the watercraft 22. The interface 94 can be connected to the data-processing unit 82 by means of a fifth signal connection 96. The interface is moreover connected to the dispenser 46 for the signal line 44 by means of a sixth signal connection 98. The signal line 44 is in turn connected to the watercraft 22. The data-processing unit 82 can send signals via this connection to the watercraft 22 and receive them from the latter, for example to steer it, to request the emitting of the acoustic signal (ping), to obtain any video and/or photographic data from the watercraft, etc.

The computing unit moreover has a power distribution system 100 in order to supply energy to the individual electrical components of the transport box 20 such as, for example, the computing unit 32, the sensor head 36', the fixing element 92, etc. The energy can come from a replaceable and/or rechargeable battery 102 which is connected to the power distribution system 100 by means of an electrical contact 104. It is in principle also possible to route a power cable from the base station to the transport box 20 in order to feed energy to the power distribution system, in particular when a signal line is already routed from the base station to the transport box 20.

Although many objects have been described in connection with a device, it should be understood that these aspects also represent a description of the corresponding method such that a block or a structural element of a device is also to be understood as a corresponding method step or as a feature of a method step. Analogously thereto, aspects which have been described in connection with or as a method step also represent a description of a corresponding block or detail or feature of a corresponding device.

The above described exemplary embodiments represent just one illustration of the principles of the present invention. It should be understood that modifications and variations of the arrangements and details described herein will be apparent to other experts. It is therefore intended that the invention is limited only by the protective scope of the patent claims below and not by the specific details which have been presented herein with the aid of the description and the explanation of the exemplary embodiments.

LIST OF REFERENCE NUMERALS

20 transport box
22 watercraft
24 bracket
26 frame
28 support element
30 connecting element/hinge
32 computing unit
34 buoyancy element
36 direction-finding equipment
38 retaining device
40 sonar
42 signal-generating equipment
44 signal line
46 dispenser of the signal line
48 holder for the dispenser
50 system
52 loading device
54 means for fixing the watercraft in place in the transport box
56 tipping mechanism
58 further system
60 base station
62 traction means
64 surface of the water
66 float with antenna
72 operating unit
74 wireless signal connection
80 first signal connection
82 data-processing unit
84 second signal connection
86 third signal connection
88 actuator control system
90 fourth signal connection
92 fixing element
94 interface with the wafercraft
96 fifth signal connection
98 sixth signal connection
100 power distribution system
102 battery
104 electrical contact

What is claimed is:

1. A transport box for setting down a watercraft into water by way of a traction means, comprising:

a bracket for fastening the traction means for lowering the transport box; and a frame that is configured to receive the watercraft in the transport box, wherein the transport box is configured to receive the watercraft in an upper part and set the watercraft down into the water in a lower part, wherein the transport box is configured to receive the watercraft in a first orientation and to set the watercraft down into the water in a second orientation.

2. The transport box of claim 1 wherein the frame is movable relative to the bracket to receive the watercraft in the upper part and deliver the watercraft into the water in the lower part.

3. The transport box of claim 1 wherein the frame is connected to the bracket with a hinge such that the frame is rotatable about an axis of rotation of the hinge to receive the watercraft in the upper part and deliver the watercraft into the water in the lower part.

4. The transport box of claim 1 wherein the frame comprises a buoyancy element that has a lower density than the water such that the frame assumes a first position relative to the bracket in air and assumes a second position relative to the bracket in the water to receive the watercraft in the upper part and deliver the watercraft into the water in the lower part.

5. The transport box of claim 1 is free of an electrical connection by a cable to an operating unit when the transport box is lowered into the water.

6. The transport box of claim 1 wherein the watercraft comprises an underwater vehicle, wherein the transport box comprises:

direction-finding equipment that is configured to determine a current position of the underwater vehicle; and a computing unit that is configured to steer the underwater vehicle to a target position based on a current position of the underwater vehicle.

7. The transport box of claim 1 wherein the watercraft comprises an underwater vehicle, wherein the transport box comprises direction-finding equipment configured to determine a current position of the underwater vehicle, wherein the direction-finding equipment is arranged in the transport box such that a sensor head of the direction-finding equipment is arranged between the frame and the bracket during lowering of the transport box into the water and such that the sensor head of the direction-finding equipment is arranged in the water below the frame and the bracket.

8. The transport box of claim 1 comprising a holder for a dispenser of a signal line of the watercraft, wherein the holder is configured to interact with the dispenser such that the dispenser is arranged between the frame and the bracket while the transport box is being lowered into the water, wherein an outlet of the dispenser projects deeper into the water than all other parts of the transport box after the watercraft has been set down into the water.

9. The transport box of claim 1 comprising a float that has an antenna that is configured to receive a signal from an operating unit and relay the signal to a computing unit of the transport box or to send a signal from the computing unit to the operating unit, wherein the float is configured to be arranged movably on the traction means.

10. A system comprising the transport box of claim 1 and a loading device for loading the transport box with the watercraft, wherein the loading device is configured to receive the watercraft such that a retaining device, by way of which the watercraft can be fixed in place in the frame of the transport box, is exposed, wherein the loading device includes a tipping mechanism that is configured to tip the watercraft into the transport box such that the retaining device of the watercraft enters a fixing area of a fixing element and can be fixed in place in the frame by the fixing element.

11. A method for setting down a watercraft into water with a transport box, comprising:

introducing the watercraft into an upper part of the transport box;

receiving the watercraft in the transport box;

fastening a traction means on the transport box;

lowering the transport box into the water; and setting down the watercraft into the water from a lower part of the transport box.

* * * * *